US005782261A

United States Patent [19]

Becker et al.

[11] Patent Number: 5,782,261

[45] Date of Patent: Jul. 21, 1998

[54] COILED TUBING SIDEPOCKET GAS LIFT MANDREL SYSTEM

[76] Inventors: Billy G. Becker; David A. Tucker, Sr., both of 1604 Morse Ave., Ventura, Calif. 93003

[21] Appl. No.: 533,403

[22] Filed: Sep. 25, 1995

[51] Int. Cl.[6] ..... F04F 1/20

[52] U.S. Cl. ..... 137/155; 166/117.5

[58] Field of Search ..... 137/155; 166/117.5, 166/322

[56] References Cited

U.S. PATENT DOCUMENTS 5,483,988 1/1996 Pringle ..... 137/155

*Primary Examiner*—Gerald A. Michalsky

[57] ABSTRACT

A sidepocket gas lift mandrel assembly for installation in coiled tubing for providing gas lift to oil and gas wells is disclosed. The mandrel assembly includes inwardly projecting members offset from the centerline of the internal diameter of the housing which is adapted to receive wireline retrievable valves and latches. The gas lift mandrel housing is adapted to be connected to coiled tubing and may be of various geometric configurations for allowing the gas lift mandrel to be run into the well with coiled tubing. Conventional kickover tools are modified to include helical grooves that engage inwardly projecting camming and orienting surfaces of the mandrel assembly to orient, position and stabilize the tools while installing or retrieving wireline retrievable valve and latch assemblies.

1 Claim, 13 Drawing Sheets

COILED TUBING SIDEPOCKET GAS LIFT MANDREL SYSTEM

BACKGROUND OF THE INVENTION

The present invention is directed to wireline retrievable sidepocket gas lift mandrel assemblies for use on coiled tubing.

The use of internally mounted non wireline retrievable gas lift valves and mandrels is disclosed in U.S. Pat. No. 5,170,815. While such mandrels and valves can be used in coiled tubing, such mandrels have considerable disadvantages when it is necessary to repair or replace gas lift valves and other components therein. When repair or replacement is needed, the entire coiled tubing must be removed from the well and the mandrel must be disconnected from the coiled tubing to gain access to the gas lift valve and other components installed therein.

It will be apparent to those skilled in the art that many advantages can be enjoyed by installation of a sidepocket gas lift mandrel assembly in coiled tubing that has the capability of allowing gas lift valves and other components to be retrievable and to allow reinstallation by means of wireline tools.

SUMMARY OF THE INVENTION

The present invention is directed to a sidepocket gas lift mandrel assembly that can be used in coiled tubing to provide gas lift to oil and gas wells. The invention has several advantages in that the sidepocket gas lift mandrel can be connected to the coiled tubing and stored on a coiled tubing reel. The coiled tubing containing the sidepocket gas lift mandrel can then be injected through wellhead equipment and injector equipment commonly used in coiled tubing operations. The injection normally distorts the coiled tubing into an oval shape for passage through the injector head. The sidepocket gas lift mandrel of this invention is constructed to withstand such distortion. Dummy valves can be installed within the mandrel before the coiling process and gas lift valves may be installed by means of modified oil tools after the entire assembly has been uncoiled and injected into the well. Thus, the present invention differs from the device shown in U.S. Pat. No. 5,170,815 because such prior art gas lift valve assemblies require the coiled tubing to be removed from the well if repair or replacement is needed.

The present invention also provides for a means and apparatus that can be utilized in conjunction with conventional wireline tools whereby such wireline tools can be accurately positioned, oriented and stabilized to facilitate the removal and installation of wireline retrievable valves, latches and other components. Such modification includes the incorporation of helical grooves on at least one end of the oil tool. Such helical grooves engage inwardly projecting camming and orienting surfaces within the sidepocket mandrel assembly.

Preferably, the side pocket gas lift mandrel assembly of the instant invention will be of such a size and configuration whereby oil tools can pass through the sidepocket gas mandrel assembly to allow servicing of components installed in the coiled tubing below the sidepocket gas lift mandrel assembly. Thus, the instant invention allows for wireline tool operations at multiple depths within the installed coiled tubing.

The instant invention provides for a plurality of inwardly extending elongated members that are affixed to the walls of the sidepocket gas lift mandrel assembly. Preferably, the gas lift mandrel assembly will be of substantially the same outside diameter of the coiled tubing whereby the coiled tubing can be injected into the well by means of conventional wellhead and injector equipment. The inwardly projecting elongated members serve several functions. An upper lug assembly includes inwardly facing camming surfaces that engage helical grooves on the modified oil tool to properly position and orient the wireline tool. The upper lug assembly also has a tool activating surface that will activate various functions of the wireline tool. Another set of the inwardly facing elongated members is utilized to hold the gas valve in place with appropriate valve seal bores as well as a port extending through the wall of the mandrel assembly to allow fluid communication between the inside and outside of the mandrel assembly in response to operation of the gas lift valve. Another set of the inwardly facing elongated members functions as a latch retaining means to accommodate conventional latches to hold the gas lift valve in place. Another inwardly facing elongated member is a lower lug assembly that includes a downwardly facing camming surface and an upwardly facing ramp surface which function to orient and position the modified oil tool as the tool is utilized to install or remove gas lift valves and latch assemblies from the mandrel assembly.

DESCRIPTION OF THE PREFERRED EMBODIMENTS

The present invention can best be described by referring to FIGS. 1—12. FIG. 1A through FIG. 1D are continuations of each other with the top of the mandrel assembly being shown in FIG. 1A and the bottom of the mandrel assembly being shown in FIG. 1D. As shown in FIGS. 1A through 1D, sidepocket mandrel assembly 1 has an upper end 2 (FIG. 1A) and a lower end 3 (FIG. 1D). Preferably, the sidepocket mandrel assembly 1 will be generally cylindrical with an outside diameter substantially the same diameter as the coiled tubing.

Since the sidepocket mandrel will undergo bending and deflection as it is placed on the coiled tubing reel and as it is injected into the well, it is preferred that the material of construction have sufficient flexibility to withstand such flexing. It is also preferable that the wall thickness of the sidepocket mandrel 1 be substantially the same wall thickness of the coiled tubing. The sidepocket mandrel assembly can be attached to the coiled tubing by welding or by other suitable connection means. The preferred method of attachment is by welding to thereby provide a smooth transition between the coiled tubing walls and the wall of the sidepocket mandrel assembly.

Figure 3:
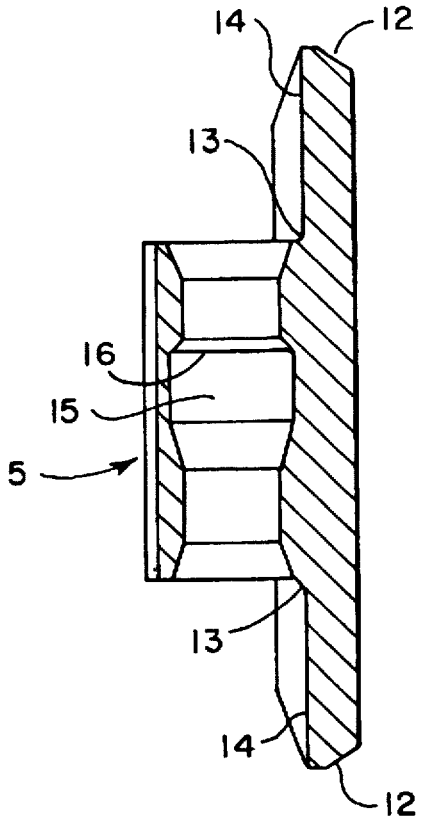
FIG. 3 is a partial cross-sectional view of the latch housing, showing the details thereof.
Figure 4:
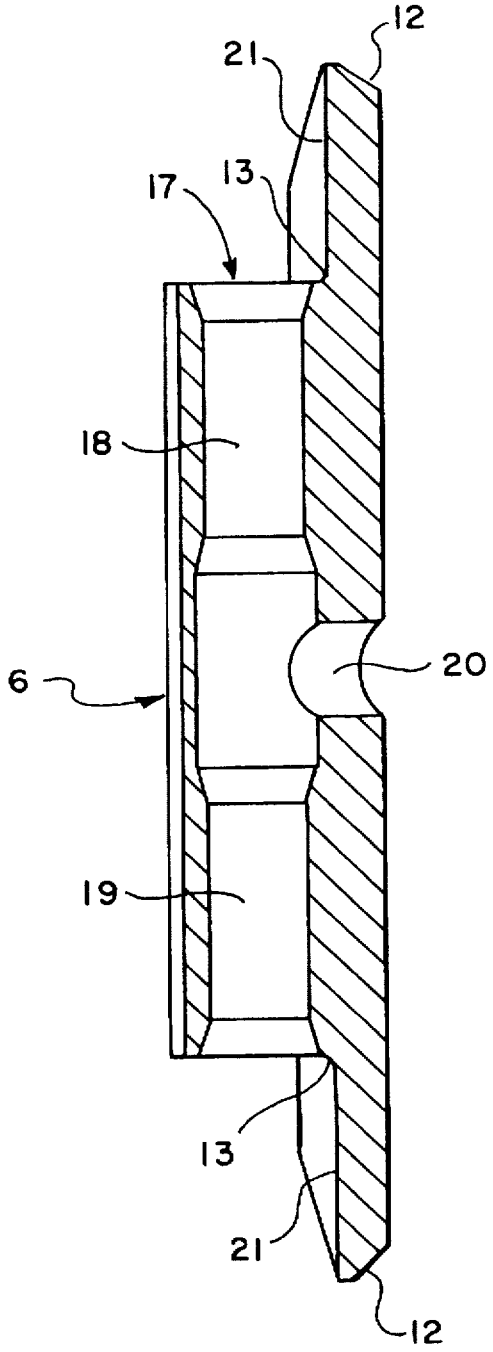
FIG. 4 is a partial cross-sectional side view of an inwardly projecting valve holder assembly showing a portion of the base in cross-section.

Upper lug assembly 4 is an elongated inwardly facing lug that is more fully described in FIG. 4. Latch assembly 5 is also an inwardly facing elongated member that is more fully described in FIG. 2. Valve holder assembly 6 is likewise an inwardly facing elongated member that is more fully described in FIGS. 3, 6 and 7. Lower lug assembly 7 is an inwardly facing elongated member that is more fully described in FIG. 5.

In a preferred embodiment of our invention, each of the upper lug assemblies, latch assemblies, valve holder assemblies and lower lug assemblies are affixed such that they extend inwardly toward the centerline of the sidepocket mandrel assembly in a single longitudinal plane. This allows for the bending and straightening of the mandrel during coiling and uncoiling operations. The alignment also allows the modified oil tool to pass upwardly and downwardly past the assemblies to install and retrieve gas lift valves and the like. The various assemblies extend toward the centerline but there is sufficient clearance to allow the oil tools, as more fully described hereafter to pass through the sidepocket mandrel assembly.

Figure 1A:
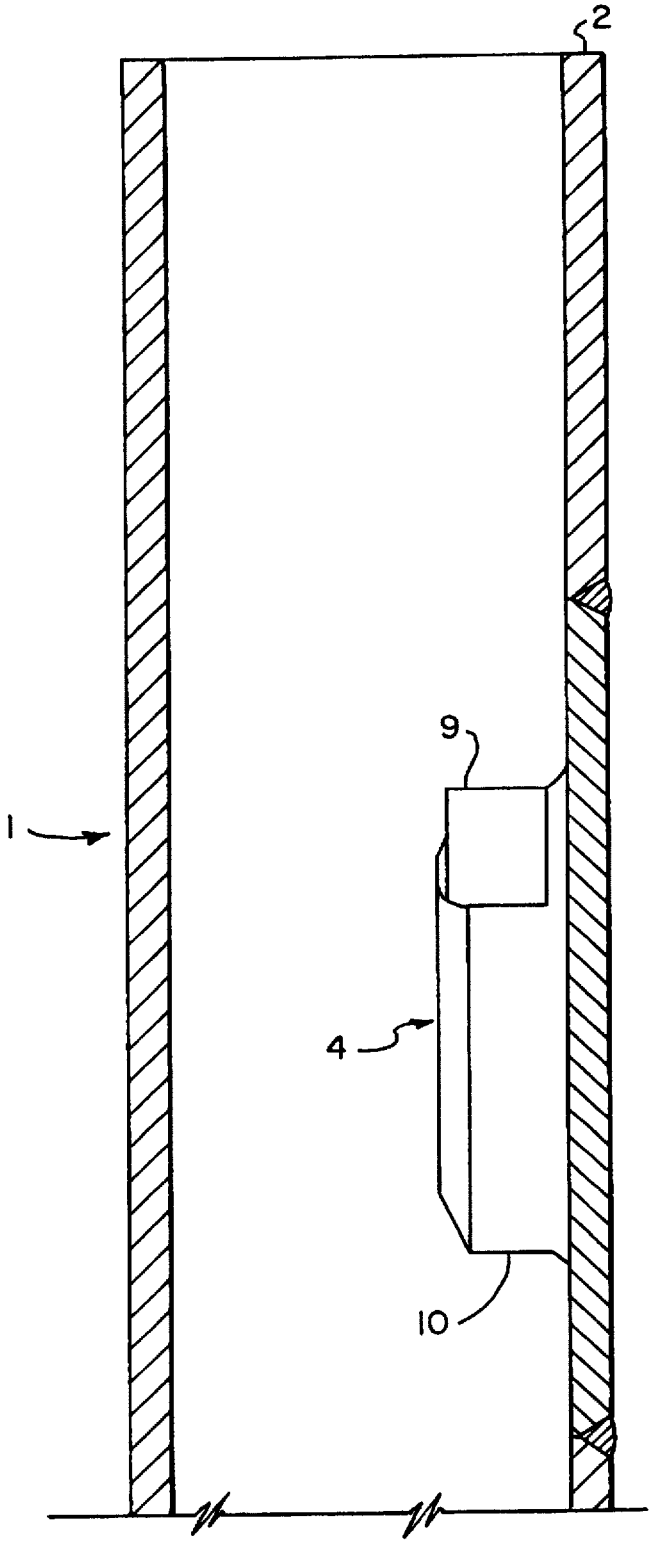
FIGS. 1A, 1B, 1C and 1D are continuations of each other showing a cross-sectional view of the sidepocket gas lift mandrel assembly of this invention with the various inwardly projecting elongated members in place with the latch and the valve holder assemblies being shown in cross-section.
Figure 2:
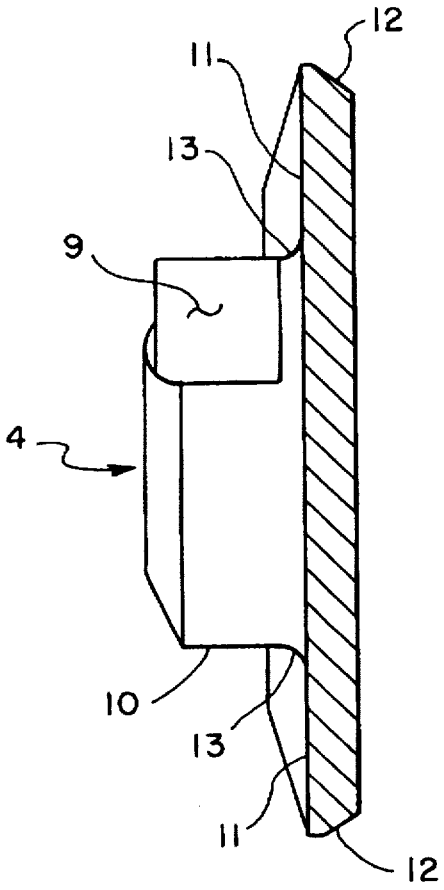
FIG. 2 is a partial cross-sectional view of the upper lug assembly showing the details thereof.

As more fully illustrated in FIGS. 1A and 2, upper lug assembly 4 has an upper orienting surface 9 that is slightly tapered to allow it to engage a modified oil tool. This upper surface can engage downwardly facing helical sections of the wireline tool to properly orient it. Upper lug assembly 4 also includes a downwardly facing tool activating stop surface 10. The upper lug assembly 4 has an upper lug base 11 that, when welded into place will form part of the continuous wall of the sidepocket mandrel assembly. Orienting surface 9 extends inwardly toward the centerline of the sidepocket mandrel assembly. Weldment areas 12 are formed in a radius to evenly distribute stresses encountered when the sidepocket mandrel assembly is subjected to bending these stress radii 13 reduce cracks and other failures during such bending processes.

Figure 1B:
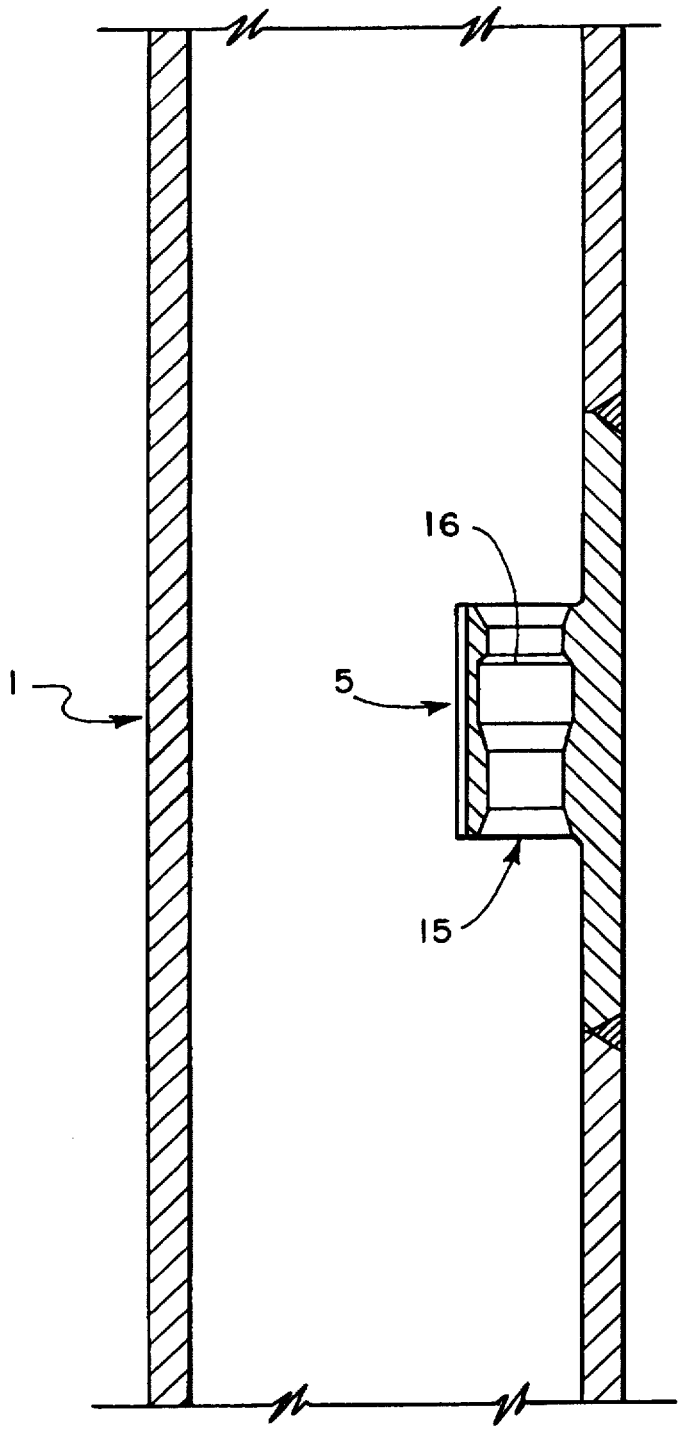
Figure 1C:
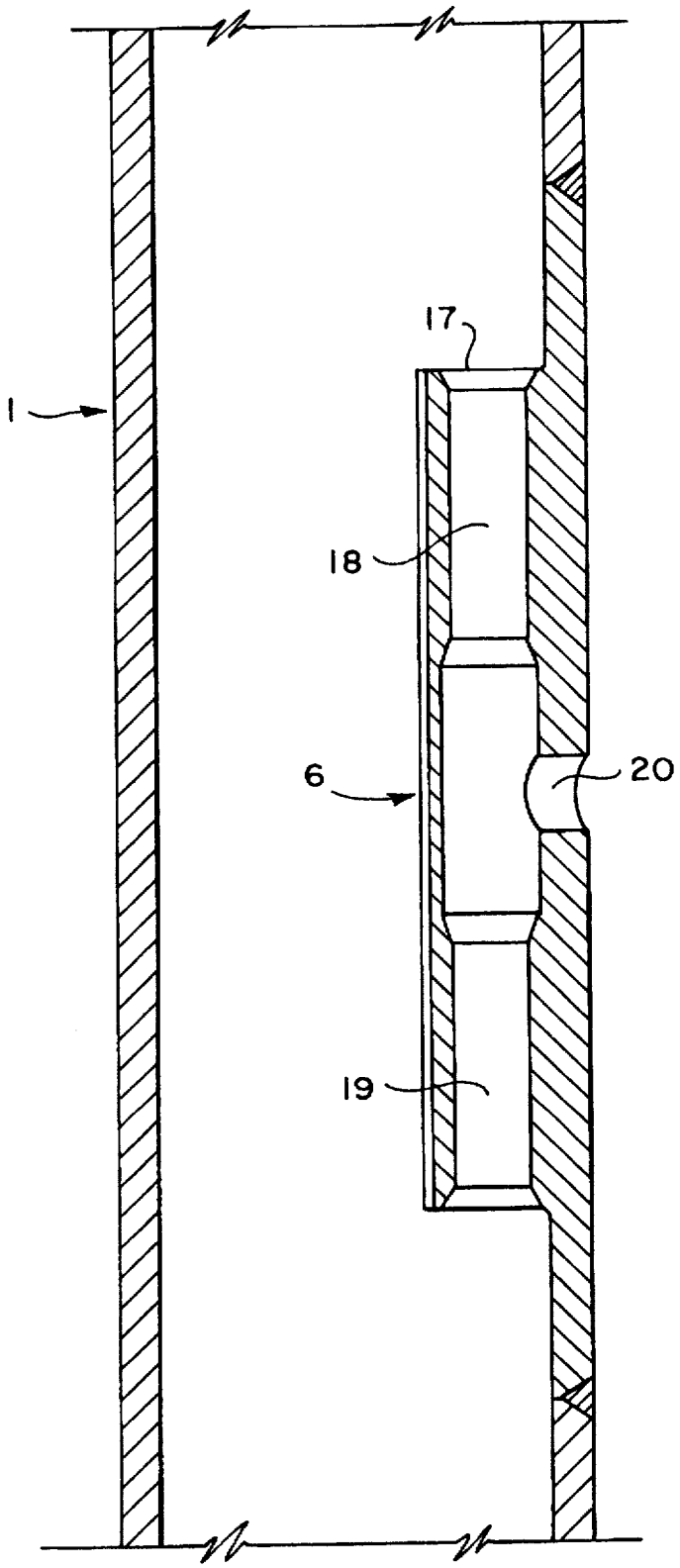

Latch assembly 5 is best described by referring to FIGS. 1B and 3. As illustrated, latch assembly 5 includes an inwardly projecting elongated member having a latch base 14 and weldment areas 12 for welding it into place in the sidepocket mandrel assembly. A central latch assembly bore 15 passes through latch assembly 5 and is sized to accommodate conventional latch assemblies. Latch assembly bore 15 has latch retainer ring 16 which functions as a small 360° latch retaining profile to accommodate conventional latches such as the BST Lift Systems Model T-1.0. Such latches are widely used to retain gas lift valves within gas lift valve holders. As noted above with regard to the upper lug assembly 4, stress radii 13 are utilized to reduce and distribute stresses in the latch assembly as the sidepocket mandrel assembly is subjected to bending forces.

Figure 7:
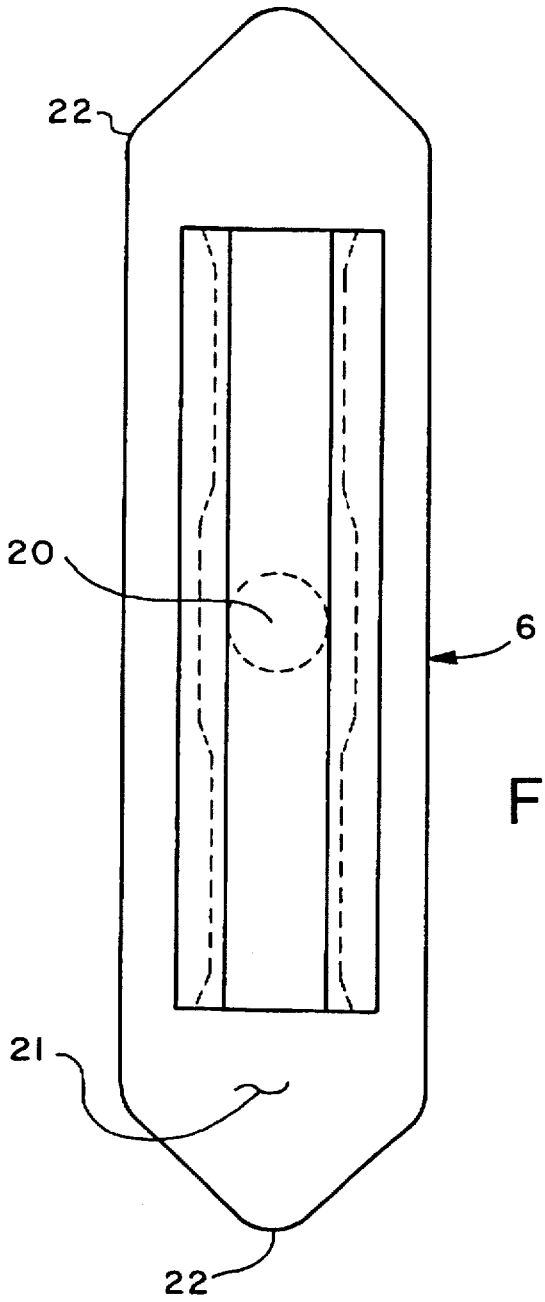
FIG. 7 is a front view of the valve holder assembly with the phantom lines illustrating the bore sections and the exit port of the valve holder assembly.
Figure 6:
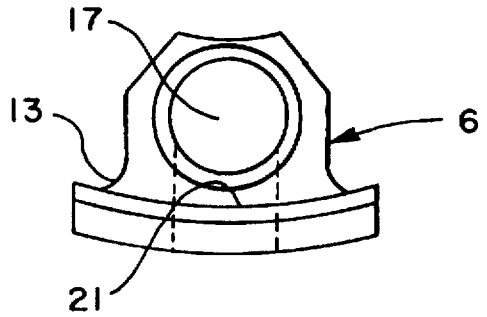
FIG. 6 is a top view of the valve holder assembly.

Valve holder assembly 6 is best illustrated by referring to FIGS. 1C, 4, 6 and 7. Valve holder assembly 6 is an elongated member that is welded into the walls of the sidepocket mandrel at weldment areas 12. A central bore 17 passes completely through valve assembly 6 with an upper polished bore area 18 and a lower polished bore area 19 to receive a conventional gas lift valve. Connecting port 20 extends from the exterior of the sidepocket mandrel to the interior of central bore 17 of valve holder assembly 6. This port allows fluid communication through the port and into the area of the bore 17 wherein fluid flow is controlled by a gas lift valve that is positioned within the central bore in sealing relationship to the polished upper bore 18 and polished lower bore 19. When properly installed, the gas lift valve will be positioned within central bore 17 and held in place by a conventional latch that engages latch assembly 5. Valve holder assembly 6 includes valve holder base 21. Again, the inwardly projecting portions of valve holder assembly 6 have stress radii 13 as the inwardly projecting portions merge with the base 21 to minimize and distribute stresses encountered during bending operations. Stress radii 13 are also illustrated in the top view of valve holder assembly 6. As shown in FIG. 7, base 21 has rounded edges 22 to further distribute stress and prevent failures after the assembly is welded into place in the sidepocket mandrel.

Figure 1D:
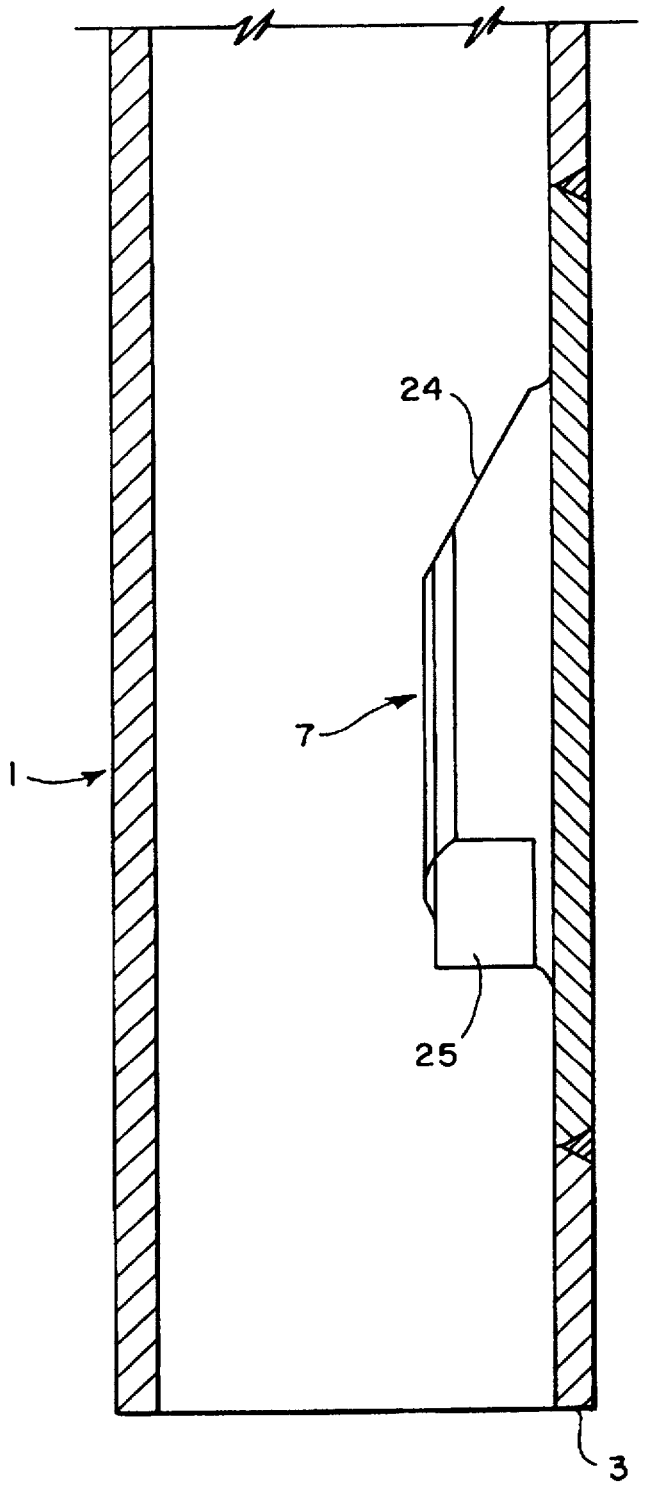
Figure 5:
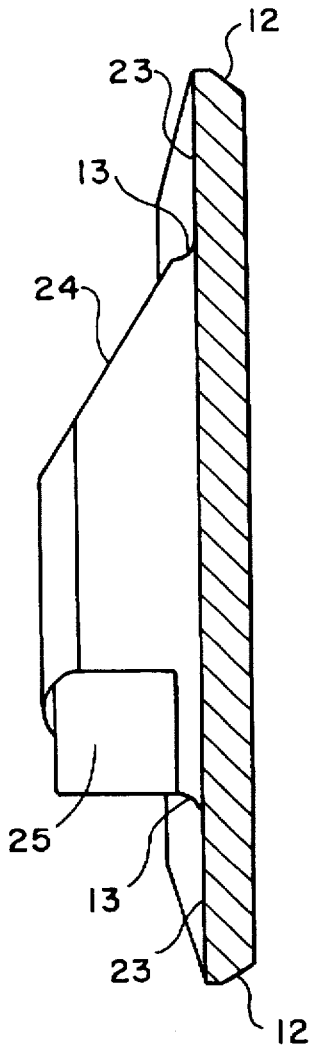
FIG. 5 is a partial cross-sectional side view of the lower lug assembly showing a portion of the base in cross-section.

Lower lug assembly 7 is best illustrated by referring to FIGS. 1D and 5. Lower lug assembly 7 is welded into place in the walls of the sidepocket mandrel assembly at weldment areas 12. The lower lug assembly includes an inwardly facing elongated member that includes an upper facing ramp surface 24 and a downward facing cam surface 25. The ramp surface and cam surface engage the modified oil tool to properly position and stabilize the tool during operations wherein the tool removes or replaces gas lift valves, latches and the like. The lower lug assembly 7 includes a lower lug base 25 and stress radii 13 in the area where in the inwardly extending elongated portion merge. The inwardly extending portion of lower lug assembly 7 is sized whereby it will fit within a vertical notch that is located in the lower portion of the modified oil tool whereby the oil tool can slid upwardly and downwardly with the lower lug assembly holding the tool in proper rotational position.

Figure 8:
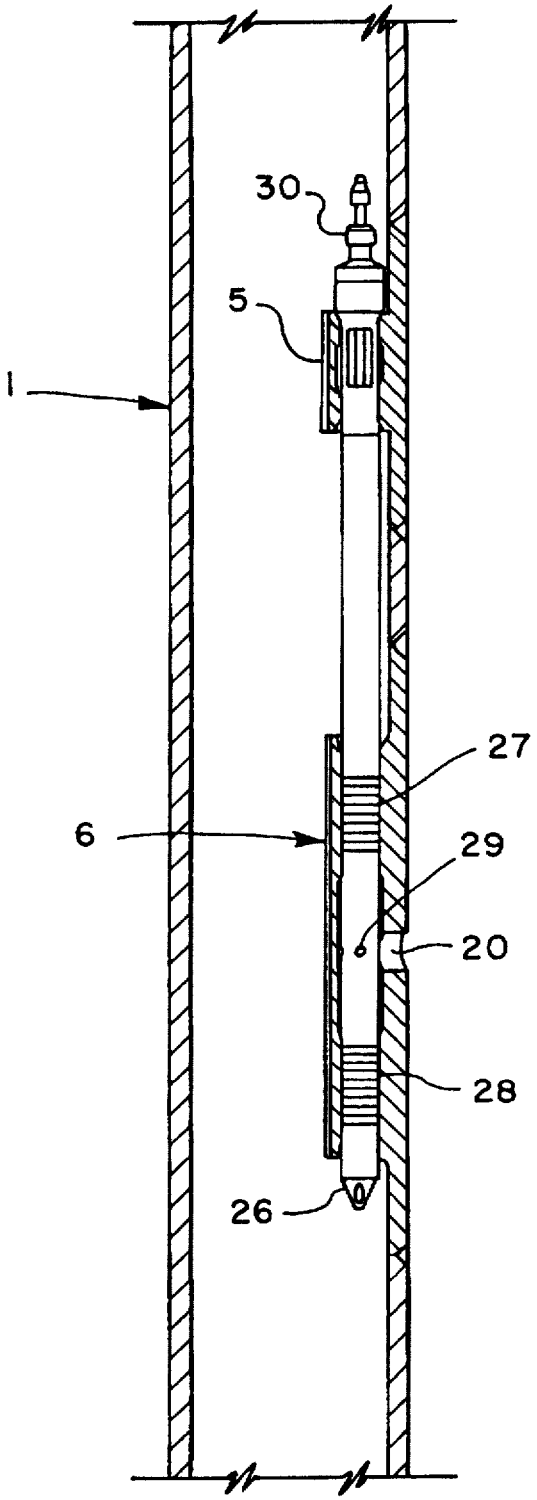
FIG. 8 is a partial cross-sectional view of a portion of the sidepocket mandrel assembly showing the gas lift valve in place with the latch mechanism in place within the valve holder assembly and the latch assembly.

FIG. 8 illustrates the installation of a gas lift valve in the sidepocket gas lift mandrel system of this invention. As shown in FIG. 8, conventional gas lift valve 26 is installed within the interior bore of valve holder assembly 6 such that upper valve seal means 27 engage the polished upper bore 18 of the valve holder assembly and lower valve seal means 28 engage the surfaces of lower polished bore 19. Such seal means can be any conventional seal such as a combination of O-rings. Port 20 allows fluid communication from the exterior of the gas lift mandrel assembly to the interior of valve holder assembly 6. Gas lift valve communication port 29 allows the flow of fluid from or to the interior of the gas lift mandrel. The gas lift valve 26 is held in place by a conventional wireline retrievable latch 30 which engages latch retainer ring 16 in latch assembly 5. By using conventional wireline tools, latch 30 along with gas lift valve 26 can be removed or installed into valve holder assembly 6 and latch assembly 5. As noted above, the latch and gas lift valve can be removed or installed into valve holder assembly 6 and latch assembly 5. Also as noted above, the axes of valve holder assembly 6 and latch assembly 5 are aligned and in a common line along with upper lug assembly 4 and lower lug assembly 7.

Figure 10:
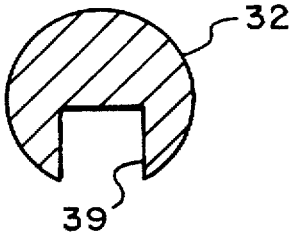
FIG. 10 is a cross-sectional view of the lower portion of the wireline tool of FIG. 9 taken along section lines 10—10.
Figure 9:
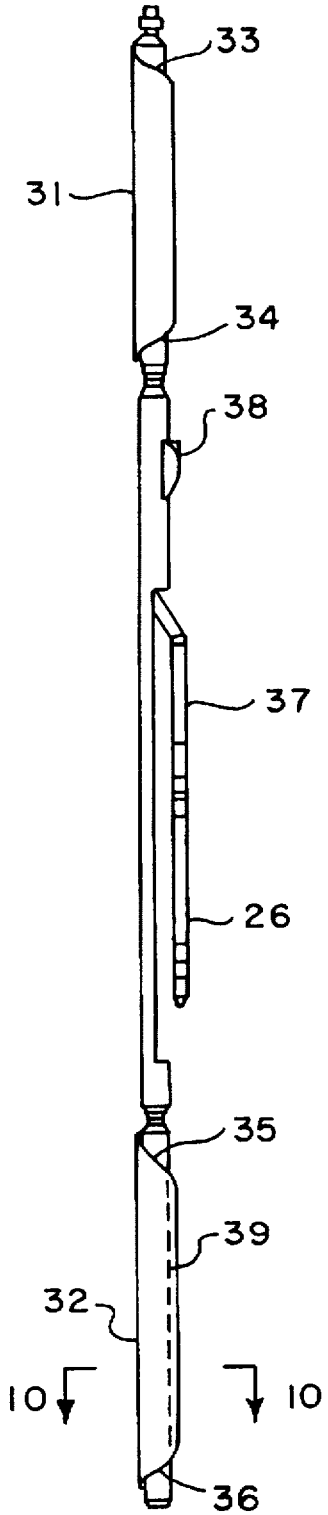
FIG. 9 is a side view of an orienting wireline kickover tool of the present invention with a typical wireline running tool, latch and gas lift valve.

FIGS. 9 and 10 illustrate a modified oil tool that can be utilized in this invention. The oil tool is a modified kickover tool such as the OK-6 type tool commonly known in the industry and manufactured by Camco or Specialty Machine Supply. The kickover tool includes modified subsections. As shown, the kickover tool includes an upper orienting subsection 31 and a lower orienting subsection 32. The upper orienting subsection includes upper facing helical sections 33 and downward facing helical section 34. The lower orienting subsection includes an upper facing helical section 35 and a lower facing helical section 36. As shown in FIG. 10, an orienting groove 39 runs vertically up the length of lower orienting subsection 32. In a preferred embodiment upper orienting subsection 31 has a similar vertical groove in it. This helical groove is shown by the phantom lines appearing in FIG. 9. The kickover tool also includes a running and pulling arm on 37 and a trigger 38. The running and pulling arm 37 has a suitable fixture for releasably engaging a conventional latch that is utilized to hold gas lift valve 26 in place.

Figure 11:
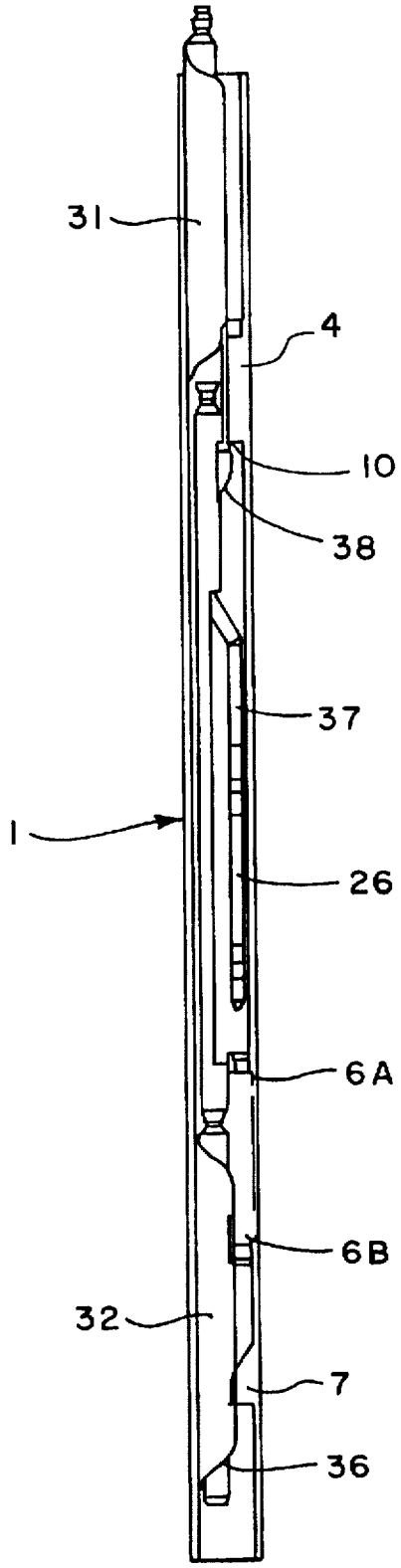
FIG. 11 is a longitudinal view showing the orienting wireline tool of FIG. 9 in the installation position within the mandrel assembly.
Figure 12:
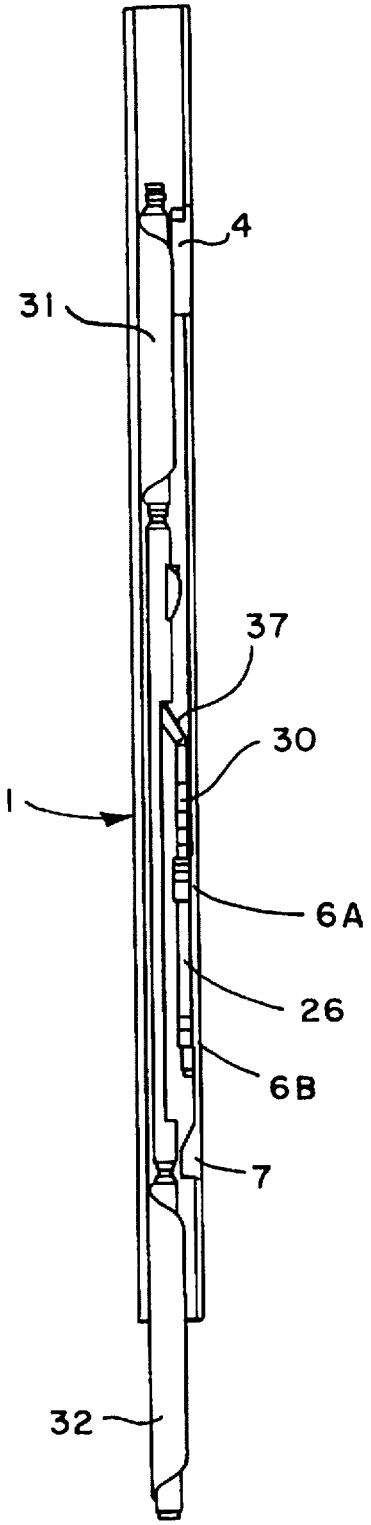
FIG. 12 is a longitudinal view of the orienting tool of FIG. 9 with a wireline pulling tool latched onto a typical gas lift valve and latch assembly in the mandrel assembly of the present invention.

The operation of the modified oil tool can best be described by referring to FIGS. 11 and 12. In FIG. 11, the entire oil tool is lowered into the coiled tubing and it passes down through the sidepocket mandrel system. As the oil tool passes downwardly, lower facing helical section 36 first comes in contact with upper lug assembly 4 and the helical surface causes the oil tool to rotate to a point wherein slot 39 aligns with upper lug assembly 4 to rotate the entire tool with the tool then sliding down past upper lug 4. Running and pulling arm 37 is in a retracted position whereby it clears upper lug assembly 4. The tool then passes downwardly until downward facing helical section 33 contacts lower lug assembly 7 which will cause the rotational alignment of the oil tool to align slot 39 with lower lug assembly 7. The tool then continues to pass downwardly to a point wherein trigger 38 slides over upper lug assembly 4.

Normally, trigger 38 is springloaded whereby it is biased outwardly and the cammed lower surface of trigger 38 rides over the top of upper lug assembly 4. The oil tool continues downwardly until trigger 38 clears the lower tool activating stop surface 10 of upper lug assembly 4. At that point in time, the oil tool can then be raised upwardly and when the upper face of trigger 38 contacts tool activating stop surface 10, further upward pressure will cause running and pulling arm 37 to extend outwardly to thereby align gas lift valve 26 in a vertical axis that corresponds with the centerline of the bore through latch assembly 5 and bore 17 in valve holder assembly 6. The tool is then lowered downwardly to a point where gas lift valve 26 is seated within bore 17 of valve holder assembly 6 and the latch is properly seated in latch assembly 6. When that is accomplished, the oil tool can then be drawn upwardly and the fitting on the end of running and pulling arm 37 can disengage the latch to leave the gas lift valve held in place by the conventional latch.

It will be appreciated that the foregoing oil tool with its modifications can be readily used with the sidepocket mandrels of this invention to allow for installation and retrieval of gas lift valves and latches and other components in coiled tubing using conventional wireline draw equipment.

The foregoing specification sets out preferred embodiments of the invention. It will be understood that various modifications may be made in the specification and claims without departing from the spirit and scope of this invention.

What is claimed is:

1. A sidepocket gas lift mandrel assembly for use in coiled tubing and for receiving a wireline retrievable gas lift valve comprising:

a gas lift mandrel housing having inwardly projecting elongated members offset from the centerline of the mandrel including a first inwardly projecting member adapted to engage an oil tool and to activate said oil tool, a second inwardly projecting elongated member offset from the longitudinal centerline of the mandrel for receiving and holding a wireline retrievable latch, a third inwardly projecting elongated member having a bore therethrough for receiving a wireline retrievable gas lift valve and a port providing fluid communication from the inside of said gas lift mandrel assembly and the outside of said gas lift mandrel assembly and upper and lower inwardly projecting elongated member for contacting and aligning an oil tool to position said oil tool with respect to said inwardly projecting elongated members.

* * * * *